US011746566B2

(12) United States Patent
Adamosky

(10) Patent No.: US 11,746,566 B2
(45) Date of Patent: Sep. 5, 2023

(54) LADDER LATCH

(71) Applicant: Jacob Adamosky, Jacksonville, FL (US)

(72) Inventor: Jacob Adamosky, Jacksonville, FL (US)

( * ) Notice: Subject to any disclaimer, the term of this patent is extended or adjusted under 35 U.S.C. 154(b) by 266 days.

(21) Appl. No.: 16/877,690

(22) Filed: May 19, 2020

(65) Prior Publication Data

US 2021/0363787 A1 Nov. 25, 2021

(51) Int. Cl.
*E05B 65/00* (2006.01)
*E05C 1/10* (2006.01)
*E04H 17/14* (2006.01)

(52) U.S. Cl.
CPC ..... *E05B 65/0007* (2013.01); *E05C 1/10* (2013.01); *E04H 17/14* (2013.01); *E05Y 2900/40* (2013.01)

(58) Field of Classification Search
CPC ..... E05C 1/04; E05C 1/10; E05C 1/08; E05C 3/042; E05C 3/14; E05C 1/16; E05C 3/34; E05C 3/24; E05C 3/22; E05B 65/0007; E05B 67/383; E05B 15/108; E05B 15/02; E05B 63/0017; E05B 63/128; E05B 63/14; E04H 17/14; E05Y 2900/40
See application file for complete search history.

(56) References Cited

U.S. PATENT DOCUMENTS 20,336 A 5/1878 Moffett
777,135 A 12/1904 Parsons
2,758,861 A 8/1956 Molloy
3,938,836 A 2/1976 Smith
3,944,266 A 3/1976 Weaver
4,673,202 A * 6/1987 Willis ..... E05B 13/04 292/264
5,339,659 A * 8/1994 Guzzinati ..... E05C 9/047 70/120
6,684,669 B1 * 2/2004 Talpe ..... E05B 63/06 292/DIG. 60
6,993,944 B2 * 2/2006 Hicks ..... E05B 13/04 70/211
7,445,254 B2 * 11/2008 Etlicher ..... E05B 63/04 292/156
7,878,558 B1 * 2/2011 Bell ..... E05B 63/244 292/341.15
9,226,622 B2 1/2016 Le
10,808,440 B2 * 10/2020 Tiilikainen ..... E05B 63/14
2009/0013737 A1 * 1/2009 Talpe ..... E05B 37/16 70/285
2010/0156119 A1 * 6/2010 Mueller ..... E05B 65/0007 292/126

(Continued)

FOREIGN PATENT DOCUMENTS

GB 2254365 A 7/1992

*Primary Examiner* — Mark A Williams
(74) *Attorney, Agent, or Firm* — Mark Young, PA

(57) ABSTRACT

A lock includes a pair of spaced apart parallel bolts connected by a plate extending between the bolts. A slot, formed in a hinged structure, such as a gate, extends from a free edge of the structure (an edge opposite a hinged edge) to an end point at a determined distance from the free edge. The plate is received in the slot. Each bolt is located on an opposite side of the hinged structure, when the plate is received in the slot. The slot defines a range of sliding motion of the plate and bolts.

20 Claims, 21 Drawing Sheets

(56) References Cited

U.S. PATENT DOCUMENTS

| | | | | |
|---|---|---|---|---|
| 2015/0084347 | A1* | 3/2015 | Olsson | E05C 1/08 292/137 |
| 2016/0115717 | A1* | 4/2016 | Attard | E05C 1/04 292/341.15 |
| 2016/0326783 | A1* | 11/2016 | Bledsoe | E05C 3/16 |
| 2017/0081887 | A1 | 3/2017 | Grommet | |
| 2019/0128023 | A1* | 5/2019 | Kashani | E05B 65/0007 |

* cited by examiner

LADDER LATCH

FIELD OF THE INVENTION

This invention relates generally to sliding bolt locks, and, more particularly, to a lock with a pair of parallel sliding bolts connected by a plate.

BACKGROUND

Fenced yards typically include a gate for ease of access. The gate, which is hinged, may be pivoted between an open and closed position. Many locking mechanisms have been devised to secure the gate in a closed position. Frequently, the locking mechanism of choice is a latch or a sliding bolt. Each such locking mechanism provides an impediment to pivoting a gate to an open position. Each such mechanism provides a locking structure on one side of the gate. Typically, such locking mechanisms are attached to gates with a few wood screws.

Problems arise from force and age. A substantial force applied to the gate may cause the wood screws to rip loose, particularly if the gate is old. Indeed, even treated wood deteriorates with long term exposure to weather, pests and sunlight.

By way of example, a backyard may be fenced to retain an animal, such as a large powerful dog. A gate may be provided for access to the backyard. The gate may include a sliding bolt or latch on the outer side of the gate, i.e., the side of the gate facing away from the fenced backyard. The dog may charge the gate for any number of reasons. The force of the dog against the gate may cause the sliding bolt or latch to fail, such as by screws being ripped from the gate or a fence post. Upon such failure, the dog is unrestrained.

What is needed is a locking mechanism for gates (and other hinged closures such as doors) that can better withstand considerable forces, even after years of exposure to weather, pests and sunlight. The locking mechanism should be easy to install and use.

The invention is directed to overcoming one or more of the problems and solving one or more of the needs as set forth above.

SUMMARY OF THE INVENTION

To solve one or more of the problems set forth above, in an exemplary implementation of the invention, a lock includes a pair of spaced apart parallel bolts. The spacing may be fixed or adjustable. Each bolt includes a locking portion and a base portion. A plate extends between the base portions of the bolts. Each bolt is connected to an end of the plate. The plate and bolts form an H shaped structure similar to that of a rung of a ladder.

A slot is formed in a hinged closure, such as a gate. The slot extends from a free edge of the closure structure (an edge opposite a hinged edge) to an end point at a determined distance from the free edge. The plate is received in the slot. Each bolt is located on an opposite side of the hinged structure, when the plate is received in the slot. A bolt is accessible from either side of the gate, door or other hinged closure. The slot defines a range of sliding motion of the plate. The slot is wide enough to receive the plate and allow sliding motion, but not so wide as to allow appreciable pivoting motion of the plate in the slot.

The free edge of the hinged structure is adjacent to a post (e.g., a fence post). When the free edge is aligned with the post, the bolts may be slid to extend from the free edge and engage the post, thereby locking the gate to the post. To unlock the gate, the bolts may be slid towards the hinged edge of the gate, until the bolts clear the post. A locking base or other structure is not necessary on the post, if the post fits between the ends. Optional features include beveled free ends of the bolts, biasing springs that urge the bolts towards a locked position, handles on the bolts, a barrel housing containing at least a portion of the bolts, a strike housing on the post for receiving a portion of the free end of each bolt, a staple for receiving a padlock or locking pin, and a linear actuator such as a rack and pinion for moving the bolts.

Exemplary locking mechanisms for a hinged wing (e.g., a door, gate, hatch, lid or other hinged closure movable from an open position to a closed position) are described. An exemplary locking mechanism includes a pair of bolts. The pair of bolts include a first bolt and a second bolt. The first bolt is spaced apart from and parallel to the second bolt. The first bolt includes a first end, a second end opposite the first end, and a first length from the first end to the second end of the first bolt. The second bolt includes a first end, a second end opposite the first end, and a second length from the first end to the second end of the second bolt. The first length and the second length may be equal.

A plate extends between the pair of bolts. The plate has a top, a bottom, a first side, a second side, a leading edge and a trailing edge. The first side of the plate is attached to the first bolt. The second side of the plate is attached to the second bolt. The leading edge is a determined distance from the first end of the first bolt, and a determined distance from the first end of the second bolt. The plate has a thickness and a width. The width, which is the distance from the leading edge to the trailing edge, is greater than the thickness of the plate and less than the first length of the first bolt and less than the second length of the second bolt. The width of the plate may be at least twice the thickness of the plate. A first distance from the leading edge to the first end of the first bolt may be about equal to a second distance from the trailing edge to the second end of the first bolt.

In some embodiments a handle may be attached to at least one bolt of the pair of bolts.

Each of the first bolt and the second bolt have a bolt diameter if the bolts have a circular cross section or a height measured from the top to bottom surfaces of the bolt if the cross section is non-circular. The bolt diameter (or height) is greater than the thickness of the plate.

In some embodiments, the locking mechanism may include a barrel, which is a structure that partially covers a bolt. A barrel may be provided for both bolts or one bolt. The barrel may include a base and an open sleeve. The open sleeve is attached to the base. A portion of the bolt is received in the open sleeve. The bolt is movable linearly relative to the open sleeve.

In some embodiments, the first end of each bolt is beveled, as in a latch bolt, and the bolts are spring-biased and configured to engage a beveled strike. A first spring and a second spring may be provided. The first spring abuts the second end of the first bolt. The second spring abuts the second end of the second bolt. The strike, which may be mounted to a door frame or fence post facing the bolts, includes a protruding member with a pair of beveled edges facing the first end of each of the first bolt and the second bolt. The strike width, which is a distance between the pair of beveled edges, is less than a distance from the first side of the plate to the second side of the plate. Thus, in the locked position the first ends of the bolts are on either side of the strike. In the unlocked position, the first ends of the bolts are away from the strike.

In some embodiments a batten may be provided on a door frame or fence post facing the leading edge of the plate. The batten has a batten width, which is less than the length of the plate. Thus, in the locked position the first ends of the bolts are on either side of the batten. In the unlocked position, the first ends of the bolts are away from the batten.

In some embodiments, a pair of channels may be provided in the door frame or fence post facing the first bolt and second bolt. Each channel is sized, shaped and positioned to receive a portion of a bolt when the bolts are in a locked position.

In some embodiments, the locking mechanism includes a locking staple configured to receive shackle of a padlock and prevent the second end of a bolt from moving to the unlocked position from the locked position. The staple is disposed between the position of the second end of a bolt when the bolt is in a locked position and the position of the second end of the bolt when the bolt is in an unlocked position.

In some embodiments, the locking mechanism may include a keeper attached to a door frame or fence post facing a bolt. The keeper may have a cross section of C-shape flanked with flanges for mounting. The C-shape is sized and positioned to receive a portion of the first end of the first bolt when the first bolt is in a locked position.

In some embodiments, a bolt includes a notch between the first end and the second end and the locking mechanism includes a spring-biased latch that is movable from a locked position, engaging the notch, to an unlocked position, releasing the notch.

In some embodiments a barrel is provided. The barrel includes a base and an open sleeve. The open sleeve is attached to the base. The second end of the bolt is received in the open sleeve. The bolt is movable from an unlocked position to a locked position. The open sleeve includes an aperture between the position of the second end of the bolt when the first bolt is in the locked position and the position of the second end of the bolt when the bolt is in the unlocked position. A pin is removably inserted into the aperture and impedes movement of the first bolt from the locked position to the unlocked position.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

In accordance with CPC Definition—Subclass E05B, as used herein bolt, latch bolt and wing have the following meanings. Bolt means a sliding member to hold a wing shut by engagement with a keeper on a frame or fence post or by engagement with a frame or fence post. It may be operated by hand directly or it may be a spring-biased latch bolt. Latch bolt means a bolt arranged to be moved to the releasing position against the force of a spring, or some other returning force, when a wing meets the frame or fence post on closing, so that it does not have to be operated by hand to secure the wing, but only to open it. Wing is a general term for a swingable closure, such as a door or gate, hatch or lid. The exemplary embodiments set forth below describe a locking mechanism according to principles of the invention.

Figure 1:
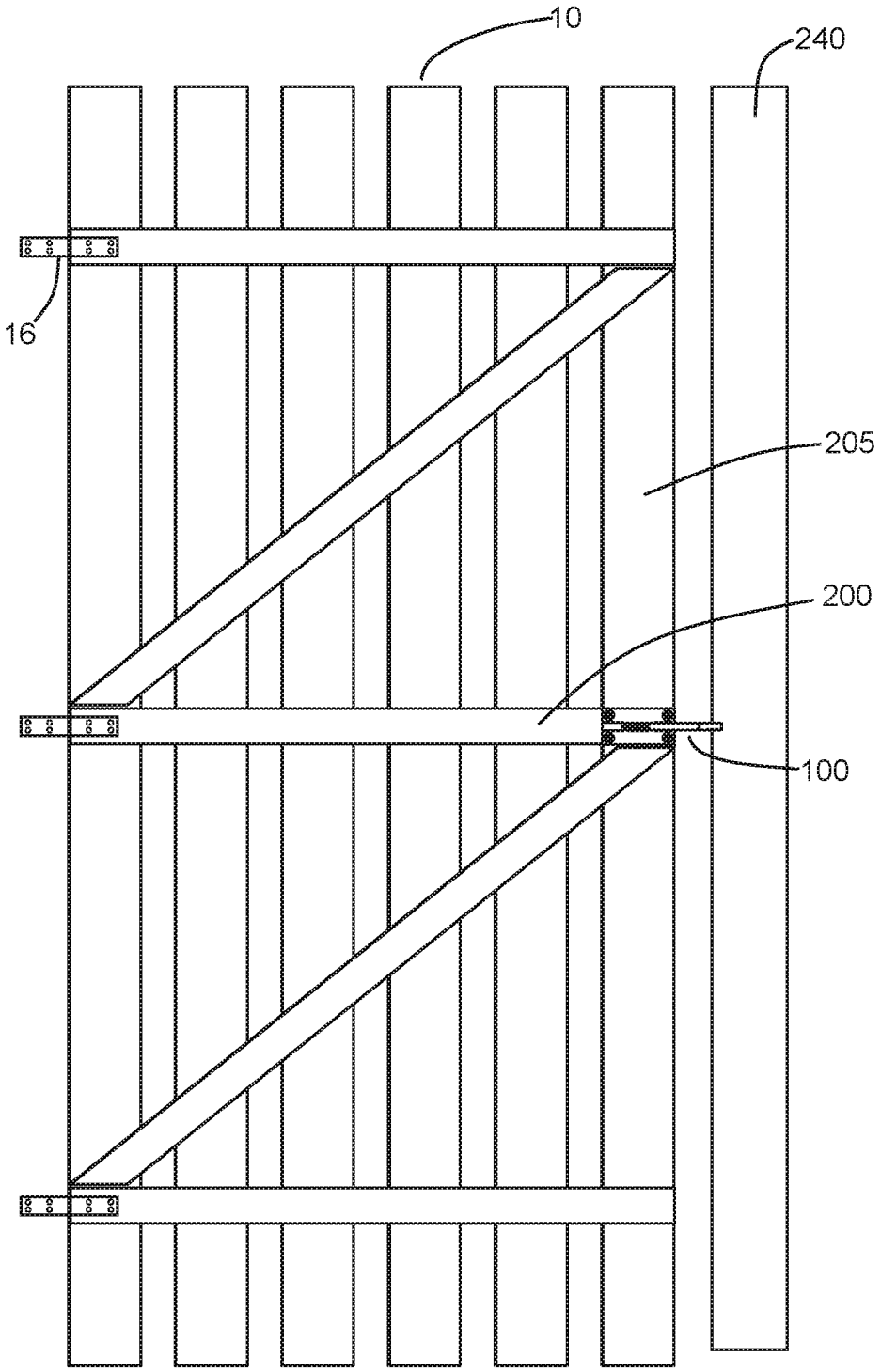
FIG. 1 conceptually illustrates a fence post and a gate equipped with an exemplary locking mechanism according to principles of the invention.

FIG. 1 conceptually illustrates a fence post 240 and a hinged wooden gate 10 equipped with an exemplary locking mechanism 100 according to principles of the invention. A lock according to principles of the invention may also be applied to a door and door frame or other swingable closures, such as hatches and lids. In the illustrated embodiment, the locking mechanism 100 is installed on a rail 200 and picket 205 of the gate 10. The locking mechanism 100 is installed at the free side of the gate 10, which is opposite the side of the gate equipped with hinges 16. The invention is not limited to use with the exemplary gate 10. The invention may be applied to other hinged gates and doors.

Figure 2:
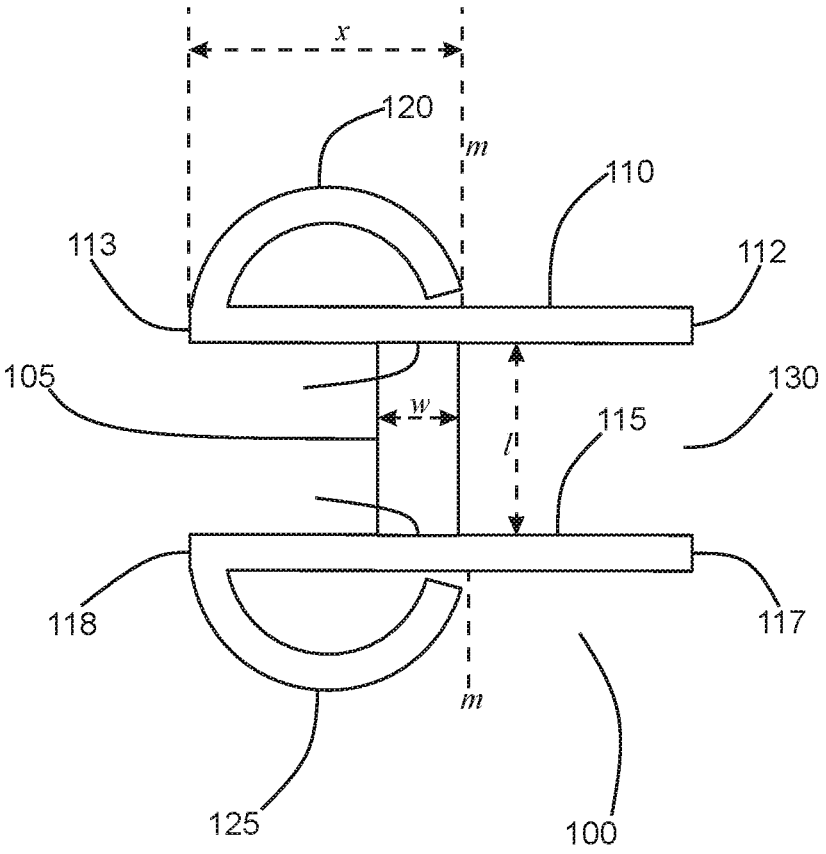
FIG. 2 conceptually illustrates an exemplary locking mechanism with a pair of parallel sliding bolts connected by a plate according to principles of the invention.
Figure 3:
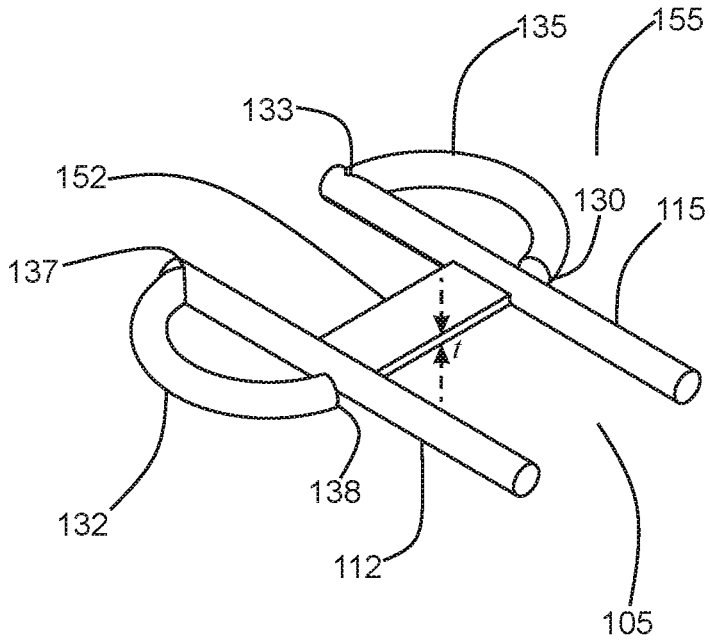
FIG. 3 provides a perspective view of the exemplary locking mechanism of FIG. 2 according to principles of the invention.

FIGS. 2 and 3 conceptually illustrate an exemplary locking mechanism 100 with a pair of parallel sliding bolts 110, 115 connected by a plate 105 according to principles of the invention. The bolts 110, 115 are rods or bars. They are generally parallel and spaced apart by a distance that is slightly greater than the thickness of the portion of the gate 10 at which the locking mechanism 100 is installed (e.g., the combined thickness of the picket 205 and rail 200).

The plate 105 is a generally rigid structure that connects the bolts 110, 115. The plate may be welded to the bolts 110, 115. A plane that bisects the bolts may also bisect the plate. However, the invention is not limited to such a configuration. The plate may be attached to the bolts, with a plane bisecting the plate being above or below a plane bisecting the bolts. The plate 105 has a length/that defines the space between the bolts 110, 115. The plate 105 also has a width w that exceeds the thickness t of the plate 105. By way of example and not limitation, the width w may be about 2 to 10 times the thickness t of the plate 105. In the exemplary embodiment, the plate is located on the side of the median m of the locking mechanism 100 that includes the handles 120, 125, away from the ends 112, 117 of the bolts 110, 115 that engage a post. In the exemplary embodiment, the plan view of the plate 105 is generally rectangular. However, the invention is not limited to a plate 105 w21ith a rectangular plan view shape.

The plate 105 is attached to the bolts 110, 115 along edges 106, 108 of the plate 105. The invention is not limited to any particular method of attachment. In one embodiment, the plate is metal and the edges 106, 108 are welded to the bolts 110, 115. In another embodiment, the plate is mechanically fastened to the bolts 110, 115. In yet another embodiment, the plate 105 is integrally formed with the bolts 110, 115, such as by casting or machining.

The plate 105 is substantially rigid. In normal use, the plate 105 will not appreciably bend or break. By way of example and not limitation, the plate 105 is composed of steel, aluminum, brass, an alloy or a composite.

An exemplary plate may have a thickness t of at least about ⅛to ¼-inch, preferably at least 3/16 to ¼-inch. The thickness of the plate 105 should not exceed the diameter (or height for blots with non-circular profiles) of the bolts 110, 115. The thickness of the plate 105 should also not exceed the width w of the plate 105. Instead, the thickness of the plate 105 should be equal to or less than the diameter (or height for bolts with non-circular profiles) of the bolts 110, 115. The thickness of the plate 105 should be less than the width w of the plate 105. By way of example and not limitation, for bolts having a diameter of ⅜-inch, the plate 105 may have a thickness t of ¼-inch and a width w of 1-inch.

A pair of handles 120, 125 are provided in the exemplary embodiment. The handles are C-shaped structures, attached to the bolts 110, 115 at one end 122, 127 (i.e., the end nearest the end of the bolt 110, 115) of the handles 120, 125. As discussed below, the opposite end 123, 128 of each handle 120, 125 is not attached to the bolt 110, 115 and is spaced apart from the bolt 110, 115. The handles are not limited to such C-shaped attachments. Rather, by way of example, knobs or linear handles protruding orthogonally from the bolts 110, 115 may be used. As another example, an end of each bolt may be bent, with the bolt having an L-shape. Any structure that protrudes from a bolt, may be readily gripped between a user's fingers, and does not interfere with sliding motion of the locking mechanism 100 may be used as a handle within the scope of the invention.

Figure 4:
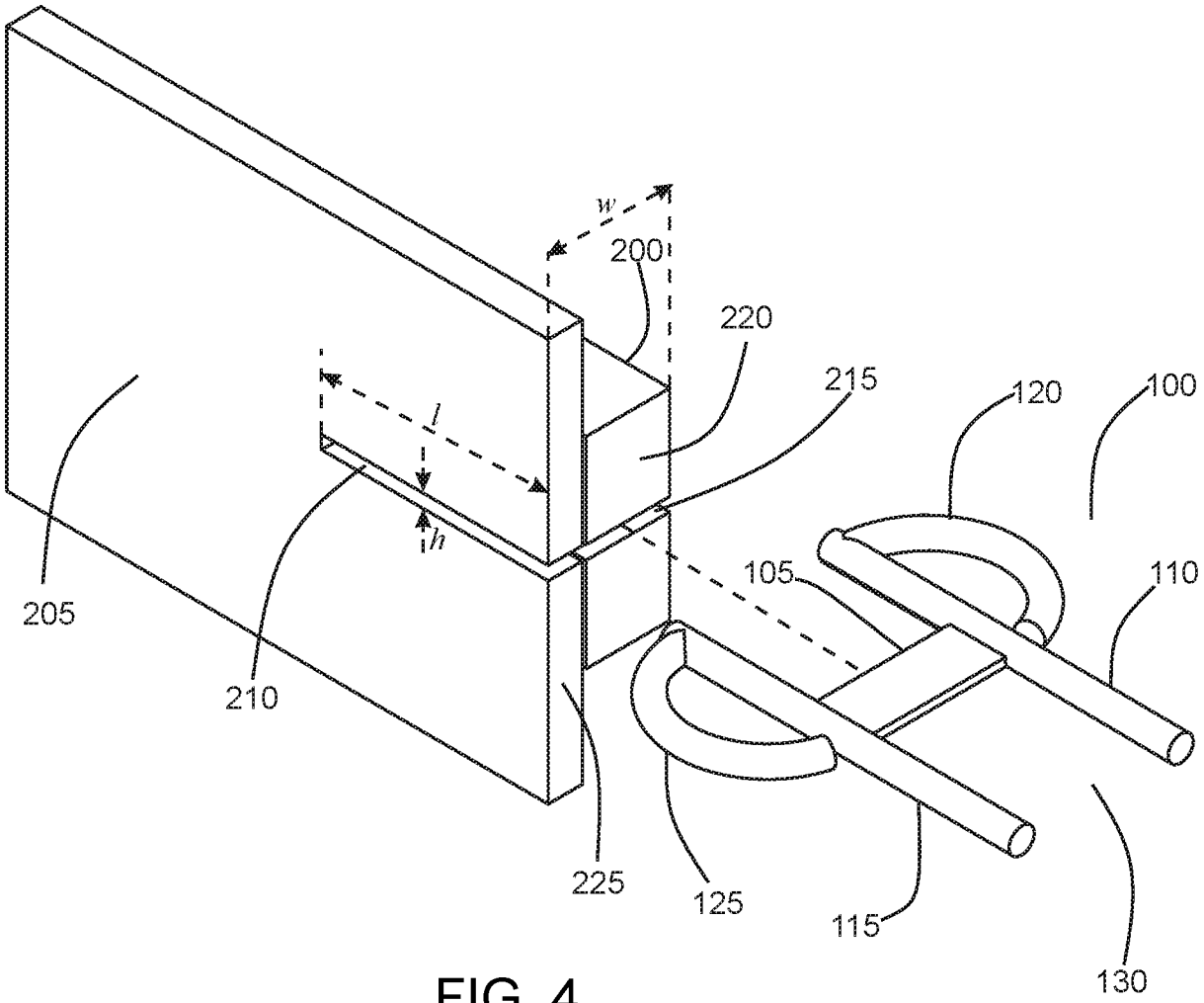
FIG. 4 conceptually illustrates the exemplary locking mechanism of FIG. 2 and a corresponding slot extending through a portion of a picket and rail of a gate according to principles of the invention.
Figure 5:
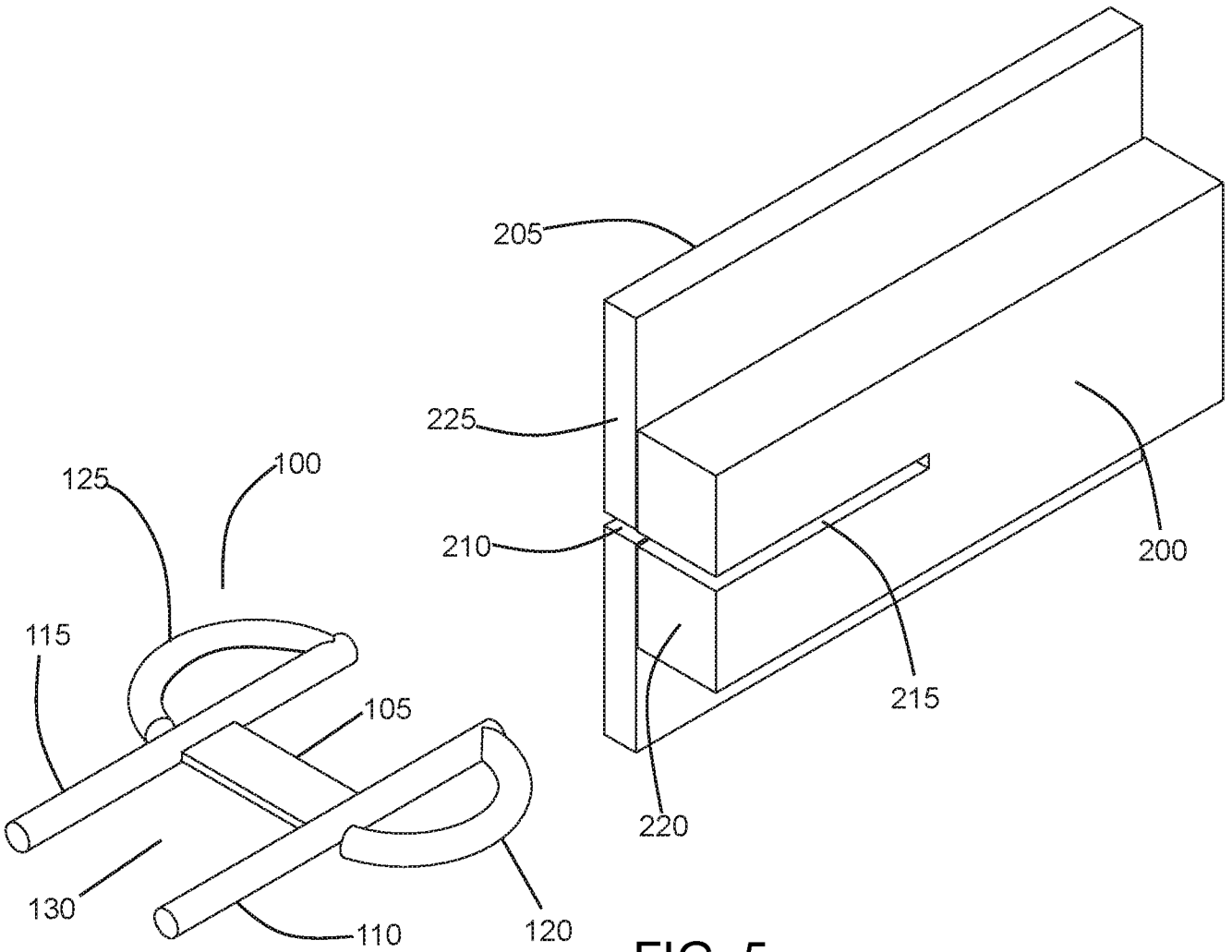
FIG. 5 provides another perspective view of the exemplary locking mechanism and corresponding slot of FIG. 4 according to principles of the invention.

FIGS. 4 and 5 conceptually illustrates the exemplary locking mechanism 100 and corresponding aligned slots 210, 215 extending through a portion of a picket 205 and rail 200 of a gate 10 according to principles of the invention. Each slot 210, 215 has a height h that slightly exceeds the thickness t of the plate 105. The combined width w of the slots 210, 215 is less than the length 1 of the plate 105. The length 1 of each slot 210, 215 is preferably about equal to the distance x from about a leading edge of the plate 105 or the middle m to the rear ends 113, 118 of the bolts 110, 115, as shown in FIG. 2. This configuration allows smooth sliding motion of the plate 105, without binding, in the aligned slots 210, 215 until the ends 112, 117 of the bolts 110, 115 are about even with the edge of the gate 10, defined by the edges 220, 225 of the rail 200 and picket 205.

Figure 19:
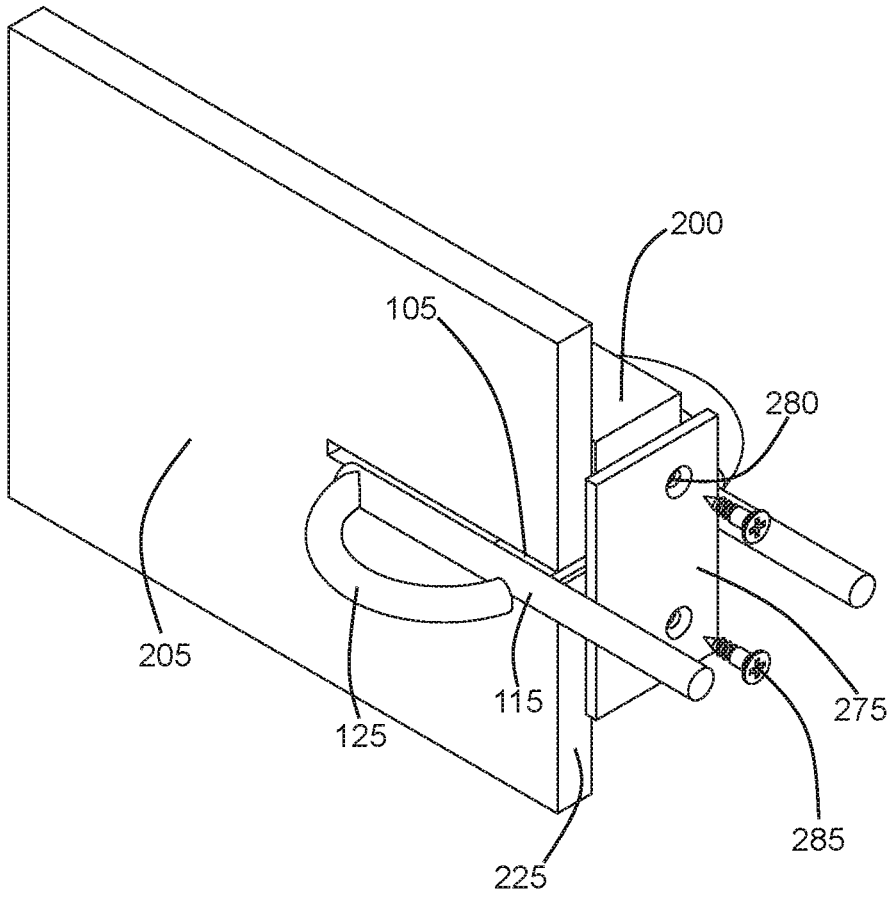
FIG. 19 conceptually illustrates an exemplary locking mechanism with a pair of parallel sliding bolts connected by a plate, installed in a slot extending through a portion of a picket and rail of a gate, and a cover plate over the ends of the slots, according to principles of the invention.

To prevent unintended removal of the plate 105 of the locking mechanism 100 from the slots 210, 215, a cover may be applied over the slots 210, 215 at the free ends 220, 225 of the picket 205 and rail 200 of the gate 10, as conceptually illustrated in FIG. 19. The cover 275 may comprise a thin planar structure with mounting holes 280, and may be attached to the free ends 220, 225 with screws 285.

Figure 6:
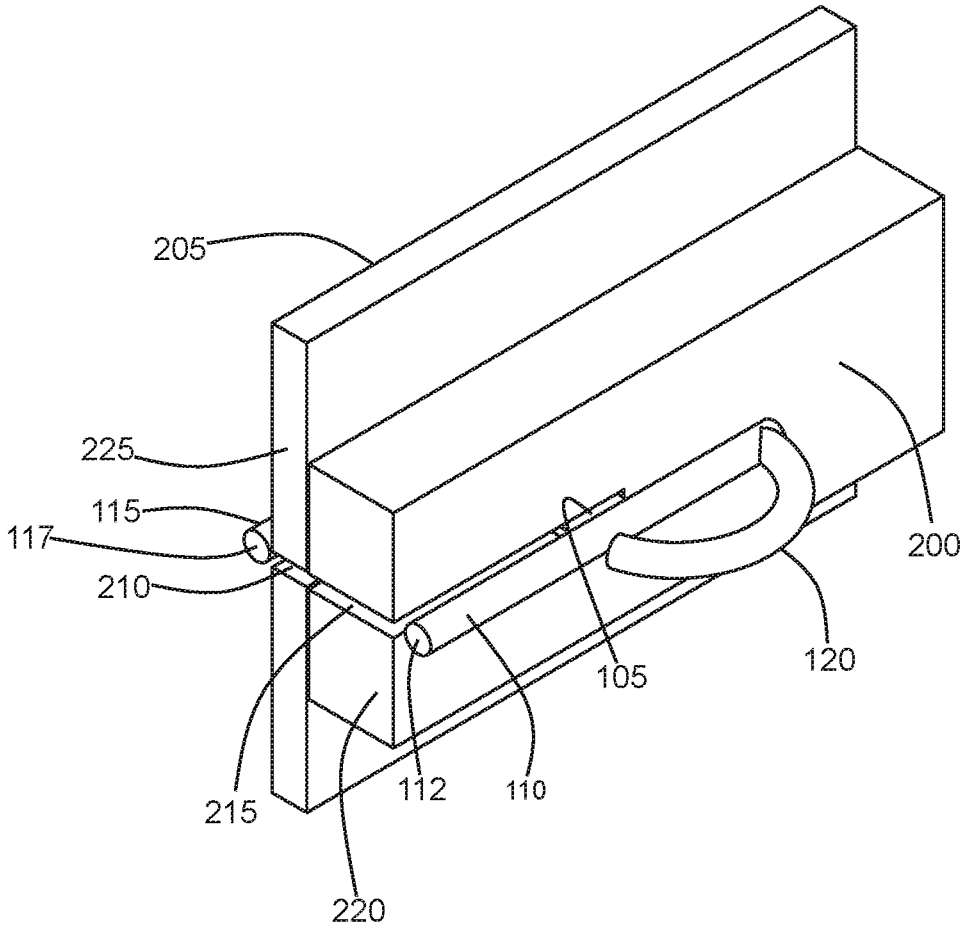
FIG. 6 provides a perspective view of the exemplary locking mechanism installed in the corresponding slot of FIG. 4, with the bolts in an unlocked position, according to principles of the invention.
Figure 8:
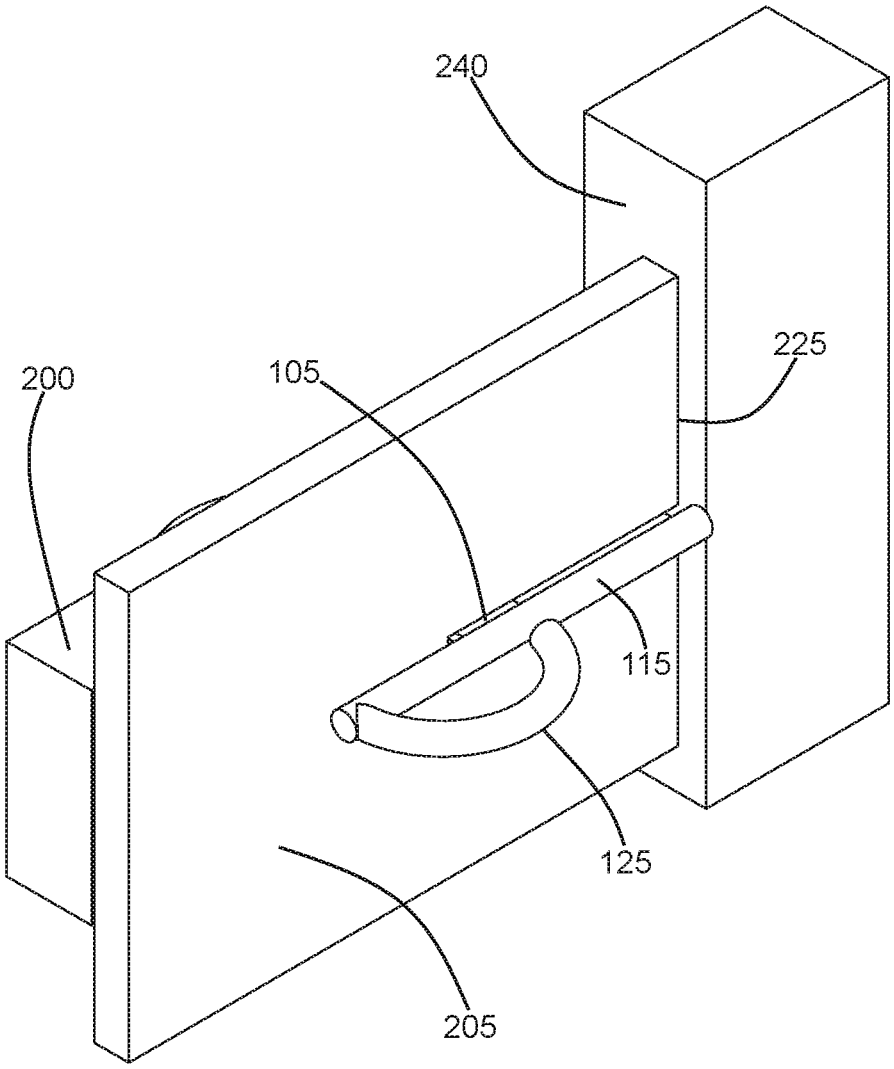
FIG. 8 provides a perspective view of the exemplary locking mechanism installed in the corresponding slot of FIG. 4, with the bolts in an unlocked position disengaged from the adjacent fence post, according to principles of the invention.
Figure 9:
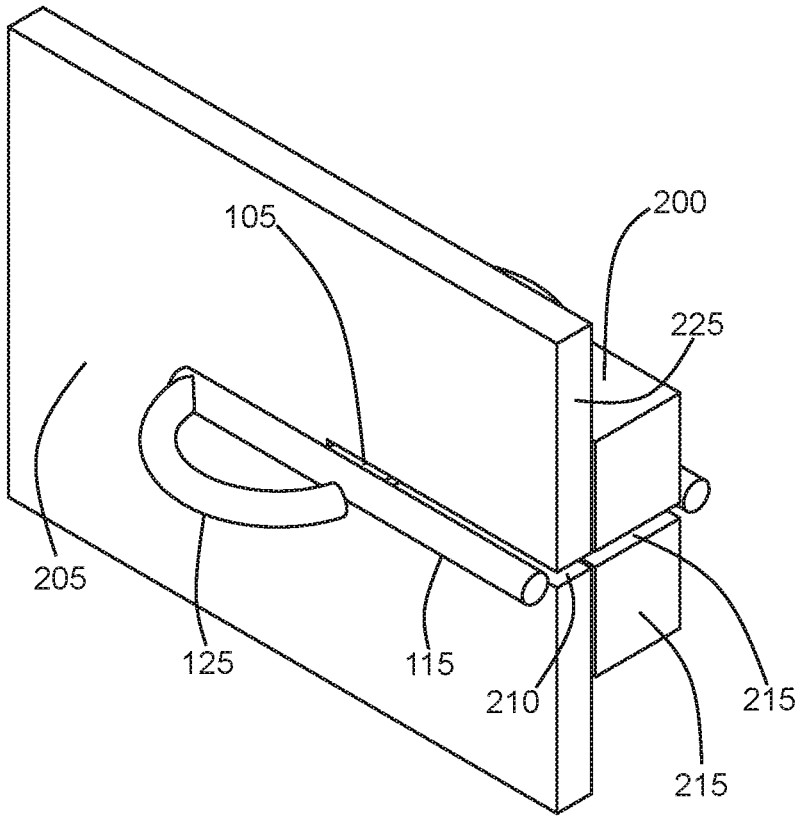
FIG. 9 provides another perspective view of the exemplary locking mechanism installed in the corresponding slot of FIG. 4, with the bolts in an unlocked position, according to principles of the invention.

FIGS. 6, 8 and 9 provide a perspective view of the exemplary locking mechanism 100 installed in the slots 210, 215, with the bolts 110, 115 in an unlocked position, according to principles of the invention. In the unlocked position, the plate 105 is slid (linearly moved) in the slots 210, 215 away from the free ends 220, 225 of the picket 205 and rail 200 of the gate 10. As the bolts 110, 115 are attached to the plate 105, sliding motion of the plate 105 causes linear translation of the bolts 110, 115. In the unlocked position, the distal ends 112, 117 of the bolts 110, 115 are adjacent to the free ends 220, 225 of the picket 205 and rail 200 of the gate 10. In the unlocked position, the bolts do not engage the fence post 240 (FIGS. 1, 8) or any structure on the fence post 240. Thus, the gate 10 may freely pivot on the hinges 16 through the full range of motion, when the locking mechanism 100 is in an unlocked position.

Figure 7:
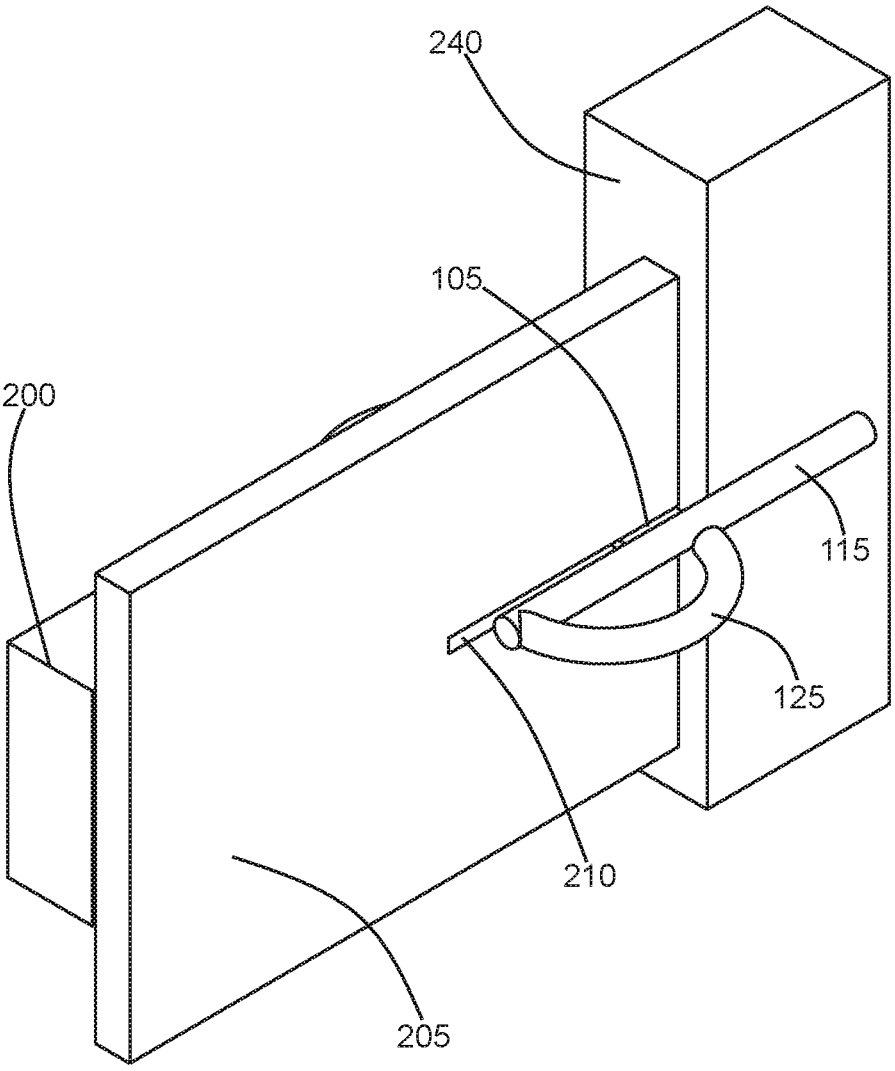
FIG. 7 provides a perspective view of the exemplary locking mechanism installed in the corresponding slot of FIG. 4, with the bolts in a locked position engaging an adjacent fence post, according to principles of the invention.

FIG. 7 provides a perspective view of the exemplary locking mechanism 100, with the bolts 110, 115 in a locked position engaging the adjacent fence post 240, according to principles of the invention. In the locked position, the plate 105 is slid (linearly moved) in the slots 210, 215 toward the free ends 220, 225 of the picket 205 and rail 200 of the gate 10. As the bolts 110, 115 are attached to the plate 105, sliding motion of the plate 105 causes linear translation of the bolts 110, 115. In the locked position, the distal ends 112, 117 of the bolts 110, 115 extend past the free ends 220, 225 of the picket 205 and rail 200 of the gate 10. In the locked position, the distal ends 112, 117 of the bolts 110, 115 engage the fence post 240, or a structure on the fence post 240 (FIGS. 10-12, 15). Such engagement prevents the gate 10 from pivoting on the hinges 16.

Force applied to the gate 10 is transmitted to the fence post 240 through the bolts 110, 115. Whether the force is applied to one side of the gate or the other side, matters little. In each case, at least one bolt 110 or 115 is urged against the fence post 240 or against a structure attached to the fence post (See, e.g., FIGS. 10-12, 15). As long as the locking mechanism 100, fence post 240 and gate 10 remain intact, the force will not cause the gate 10 to open. As long as the fence post 240 and gate 10 remain intact, the force will not cause the gate 10 to open unless a bolt 110, 115 is stressed beyond its bending yield stress, which, for a bolt comprised of steel, bronze, titanium or other durable material, would require a force exceeding any force typically applied to a gate, entryway or other hinged closure, by a human, pet, livestock, cargo or pressure differential.

Figure 10:
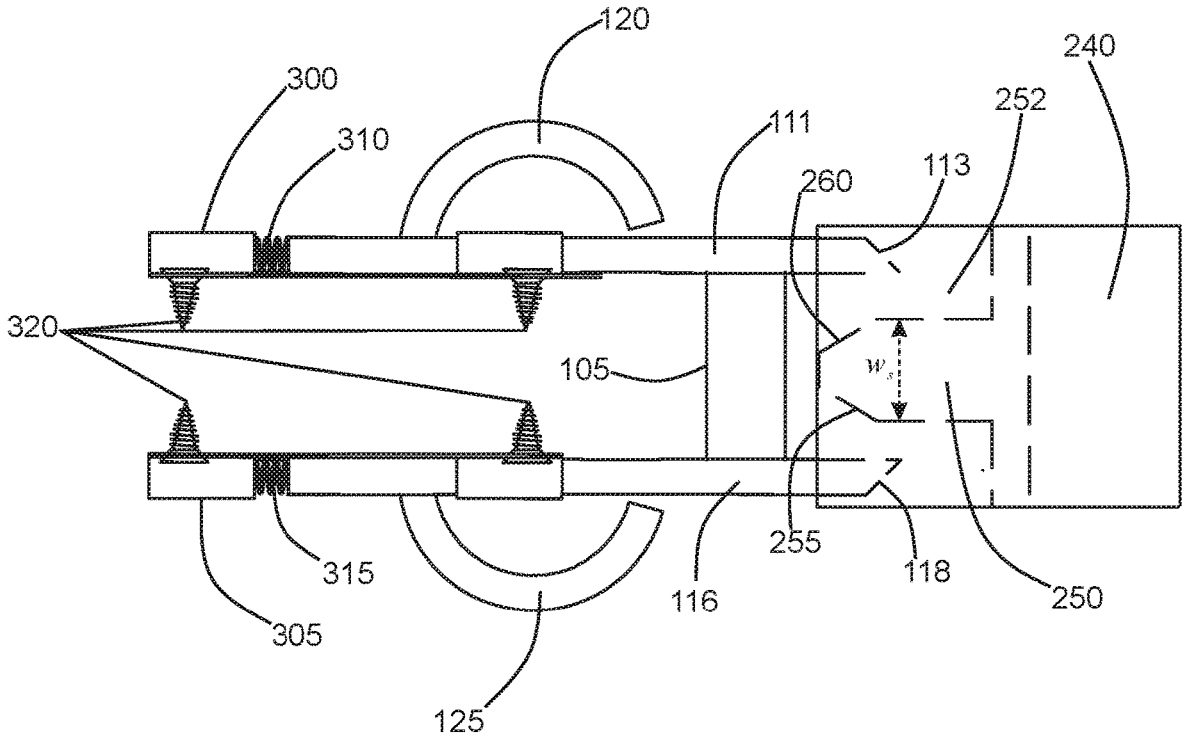
FIG. 10 provides a plan view of another exemplary locking mechanism with latch bolts and a corresponding beveled strike on an adjacent fence post, according to principles of the invention.

FIG. 10 provides a plan view of another exemplary locking mechanism 100 with latch bolts 111, 116 and a corresponding beveled strike 250 on an adjacent fence post 240. The exemplary latch bolts 111, 116 are a spring-biased set of bolts, each with a beveled edge 113, 118. The strike is a protruding structure with beveled edges 255, 260, and a width $w_s$ that is less than the distance/(FIG. 2) between the bolts 111, 116. The strike 250 may be mounted to a side of the fence post 240, or in a mortise 252 formed in a side of the fence post 240. When the gate is pushed closed, a beveled edge 113, 118 of a latch bolt 111, 116 engages a corresponding beveled edge 255, 260 of the strike 250. The springs 310, 315 allow the bolts 111, 116 to retract. Once the gate is fully closed, the bolts 111, 116 automatically extend into spaces on either side of the strike 250, holding the gate closed. The latch bolts 111, 116 are disengaged (retracted) when a user grasps a handle 120, 125 and slides the bolts 111, 116 away from the strike 250. This embodiment includes a barrel 300, 305 for each bolt 111, 116. Each barrel 300, 305 houses a spring 310, 315 and a portion of the bolt 111, 116. The base 307 (FIG. 14) of each barrel 300, 305 is a pair of opposed flanges with holes for mounting screws 320 for attaching the barrel to a gate. This embodiment allows use of a fence post 240 that is wider than the distance/(FIG. 2) between the bolts 111, 116.

Figure 21:
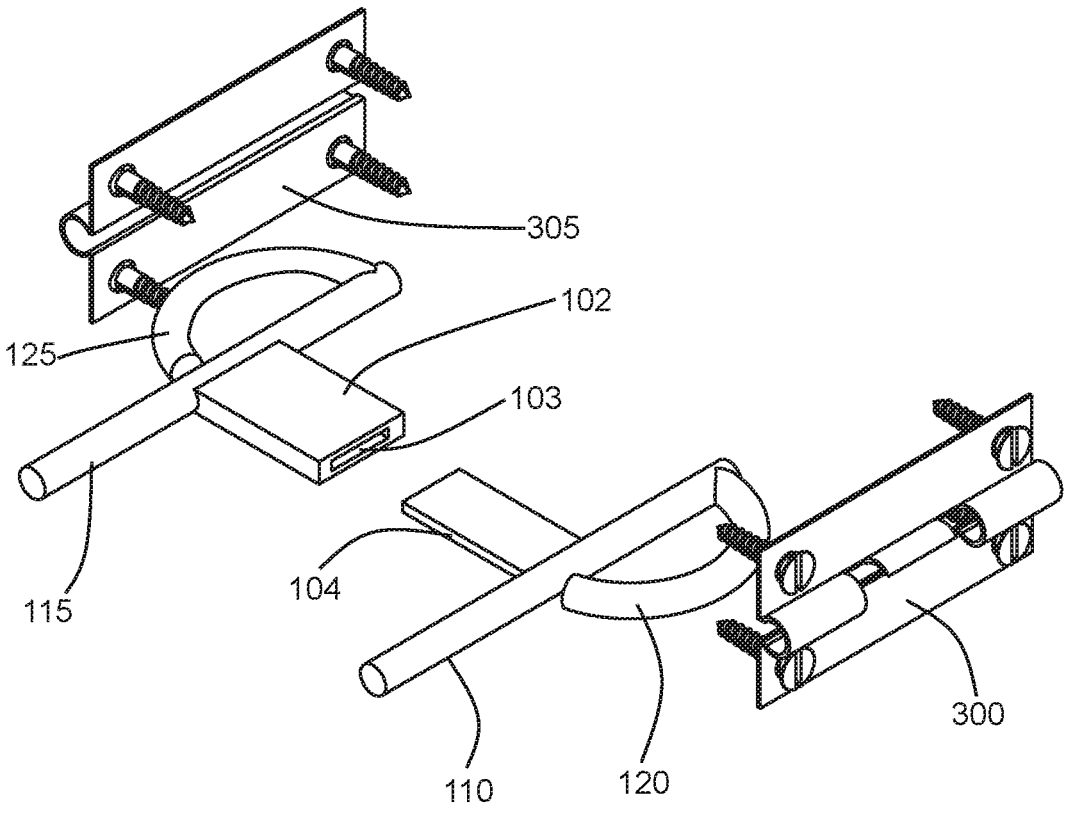
FIG. 21 conceptually illustrates an exemplary locking mechanism with a pair of parallel sliding bolts and an adjustable spacing between bolts according to principles of the invention.

With reference to FIG. 21, an exemplary locking mechanism with a pair of parallel sliding bolts 110, 115 may have an adjustable spacing between bolts 110, 115. In this embodiment, the fixed plate 105 is replaced with a pair of mating plate components. Female plate 102 includes a channel 103, into which male plate 104 is slidingly received. The male plate 104 is shaped and sized to tightly fit within the channel 103. The extent to which the male plate 104 is inserted into the channel 103 is determined by the corresponding thickness of gate picket and rail, and allowing room for sliding motion of bolts 110, 115. When installed, the barrels 300, 305 prevent separation of the male plate 104 from the channel 103.

Figure 11:
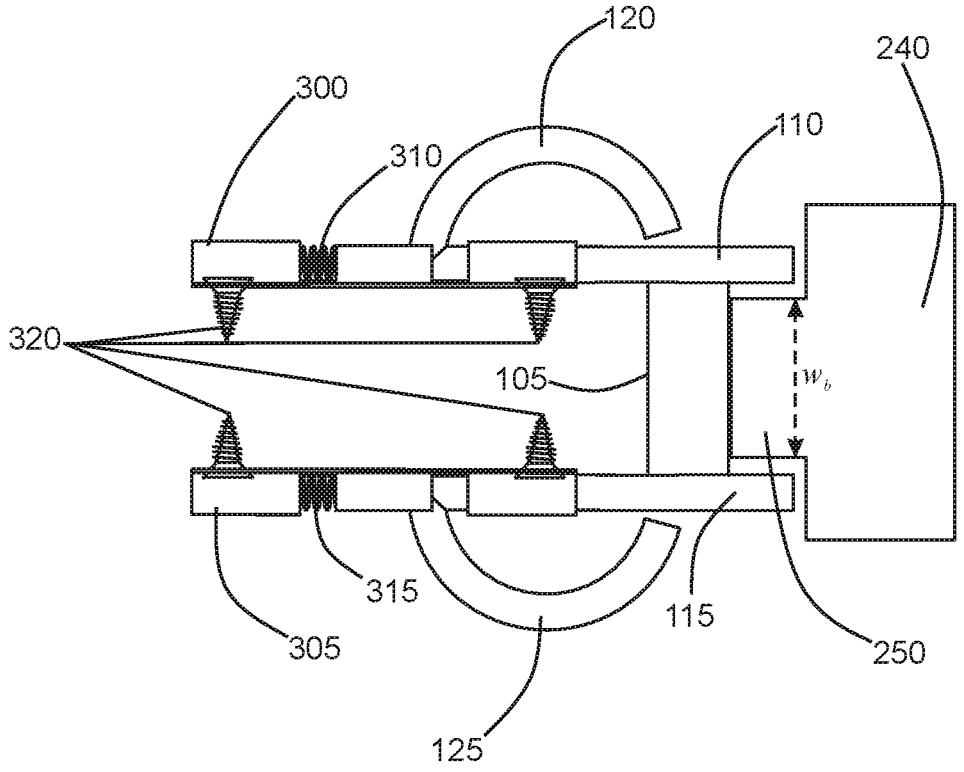
FIG. 11 provides a plan view of another exemplary locking mechanism a corresponding batten on an adjacent fence post, according to principles of the invention.

FIG. 11 provides a plan view of another exemplary locking mechanism with a batten 250 on an adjacent fence post 240. The batten 250 may be a separate component attached to the fence post 240. Alternatively, the fence post 240 and batten 250 may be integrally formed. The batten 250 and fence post may be coterminous, with the batten 250 extending from the top to the bottom of the fence post 250. Alternatively, the batten 250 may extend along a portion of the fence post 240 at the height of the bolts 110, 115. The exemplary batten 250 is a cubic structure with a width $w_b$ that is less than the distance/(FIG. 2) between the bolts 111, 116. This embodiment allows use of a fence post 240 that is wider than the distance/(FIG. 2) between the bolts 110, 115.

Figure 12:
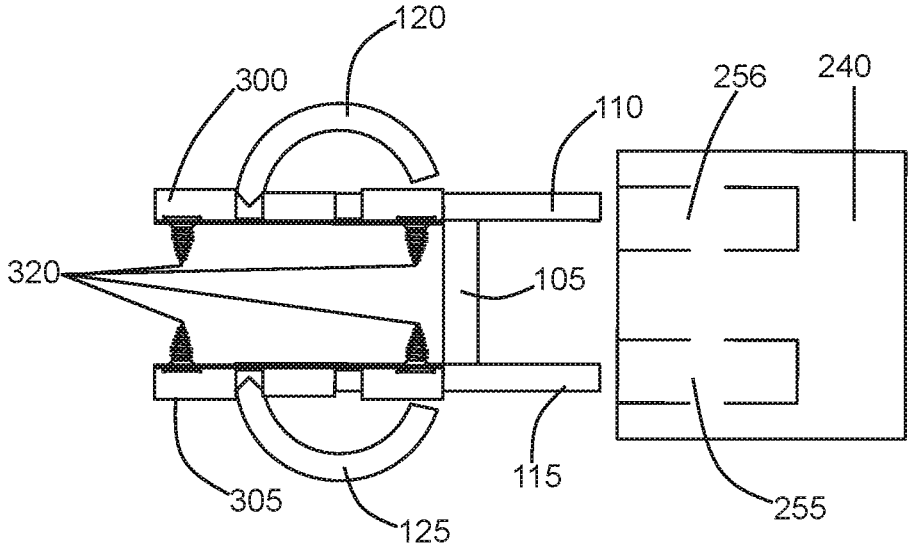
FIG. 12 provides a plan view of another exemplary locking mechanism with corresponding channels in an adjacent fence post, according to principles of the invention.

FIG. 12 provides a plan view of another exemplary locking mechanism with bolts 110, 115 and corresponding channels 255, 256 in an adjacent fence post 240, according to principles of the invention. The dimensions of the channels 255, 256 are greater than the corresponding dimensions of the ends of the bolts 110, 115, such that the ends of the bolts 110, 115 may be received in the channels 255, 256 when the bolts are in a locked position. This embodiment allows use of a fence post 240 that is wider than the distance/(FIG. 2) between the bolts 110, 115.

Figure 13:
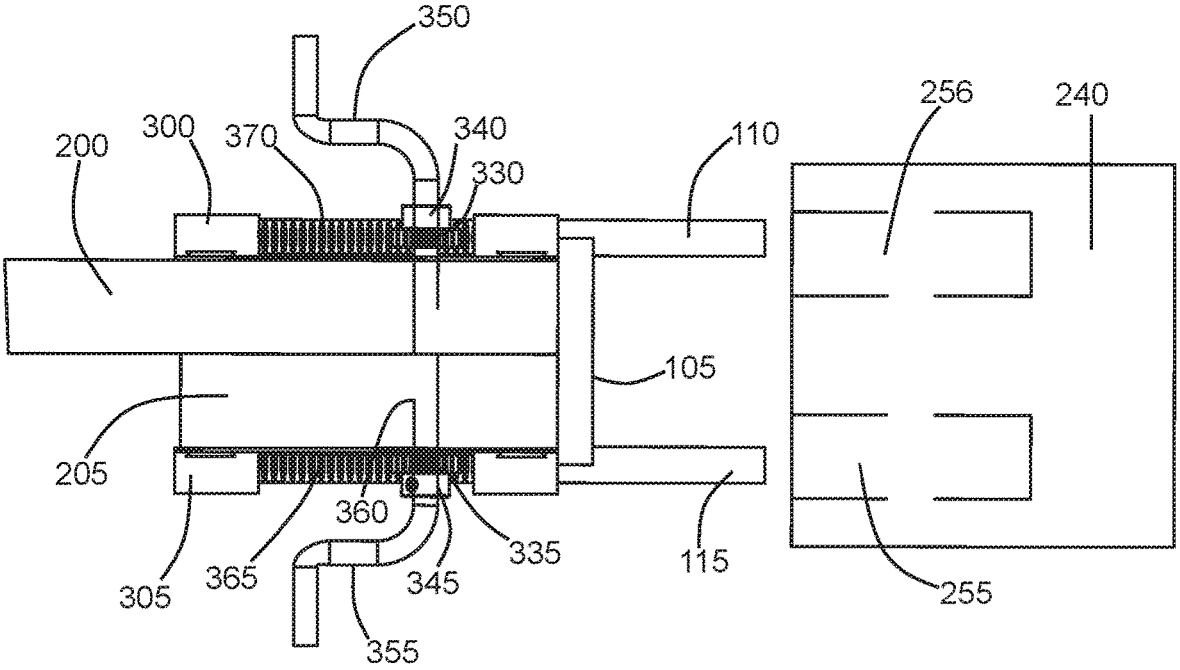
FIG. 13 provides a plan view of another exemplary locking mechanism with rack and pinion driven latch bolts, according to principles of the invention.
Figure 14:
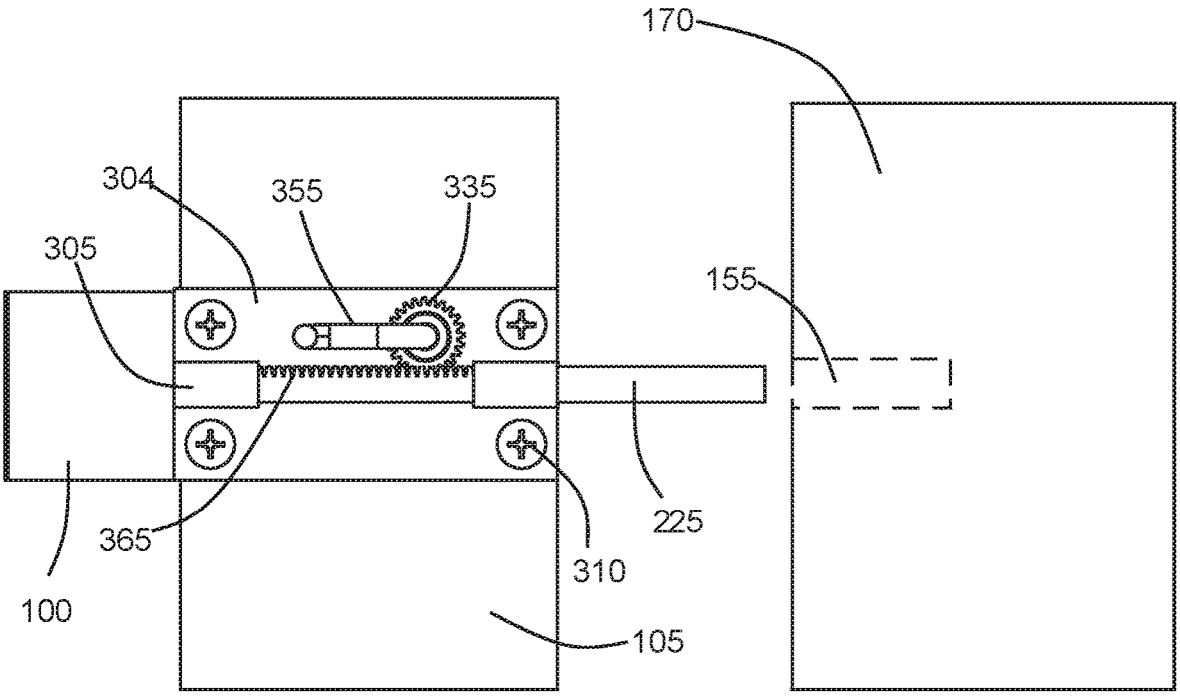
FIG. 14 provides a front view of the exemplary locking mechanism of FIG. 13, with rack and pinion driven latch bolts, according to principles of the invention.

FIGS. 13 and 14 illustrate another exemplary locking mechanism, with rack 365, 370 and pinion 330, 335 driven bolts 110, 115, according to principles of the invention. The rack 365, 370 crank 350, 355 is provided on each side of the locking mechanism to facilitate rotation of the pinions 330, 335. In the exemplary embodiment, a shaft 360 extends through a channel in the gate 10 (i.e., in the rail 200 and picket 205). The channel may be a drilled hole that extends through the rail 200 and picket 205. A coupler 340, 345 connects each pinion 330, 335 to the shaft 360. A set screw or other fastener may be provided in the coupler 340, 345 to secure the shaft 360. Rotation of a crank 350, 355 in one direction moves the bolts 110, 115 to a locking position. Rotation of the crank 350, 355 in the opposite direction moves the bolts 110, 115 to an unlocked position. Rotation of one crank 350, 355, causes rotation of the other crank 350, 355. The shaft 360, pinions 330, 335, couplers 340, 345 and cranks 350, 355, rotate but do not move linearly with the bolts 110, 115.

Figure 15:
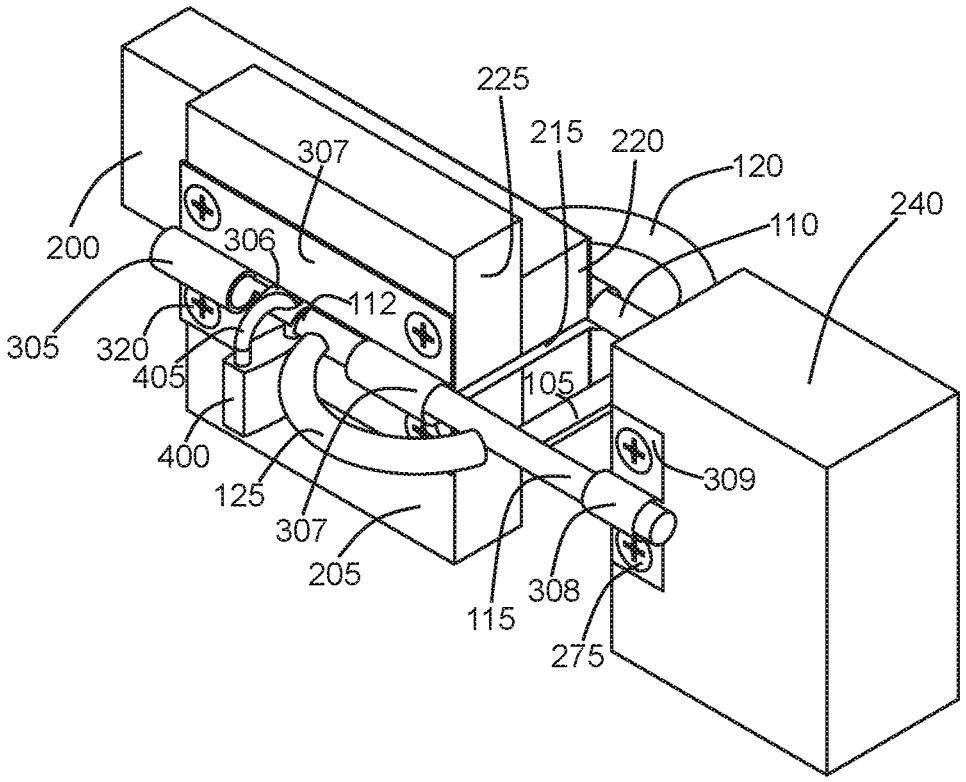
FIG. 15 provides a perspective view of an exemplary locking mechanism with a padlock, according to principles of the invention.

FIG. 15 provides a schematic of an exemplary locking mechanism with a locking staple 306 and a padlock 400. The locking staple 306 is a curved or planar structure or U-shaped structure that extends from the base 307 of the barrel 305. The locking staple 306 includes a hole or aperture through which a shackle of padlock may extend. When the shackle 405 of the padlock extends through a hole in the staple 306, the shackle 405 prevents movement of the bolts 110, 115 from the locked position to the unlocked position. In the exemplary embodiment, the barrel includes a head 307 and tail 305 sections. The staple 306 is disposed between the head 307 and tail 305 sections.

The embodiment of FIG. 15 also illustrates a keeper 308 on the fence post 240. The keeper 308 is generally shaped like an upper-case Greek letter omega, Ω, with a C-shaped portion flanked with flanges at the open side of the C. The keeper 308 includes a mounting base 309 with holes through which mounting screws 275 extend. Such a strike and fence post may be use with other embodiment of locking mechanisms, according to principles of the invention.

The embodiment of FIG. 15 shows a locking staple 306 and keeper 308 on one side of the gate. Another locking staple and/or strike may be provided on the locking mechanism on the opposite side of the gate. Alternatively, the locking staple and/or strike may be provided on the locking mechanism only on one side of the gate.

Figure 16:
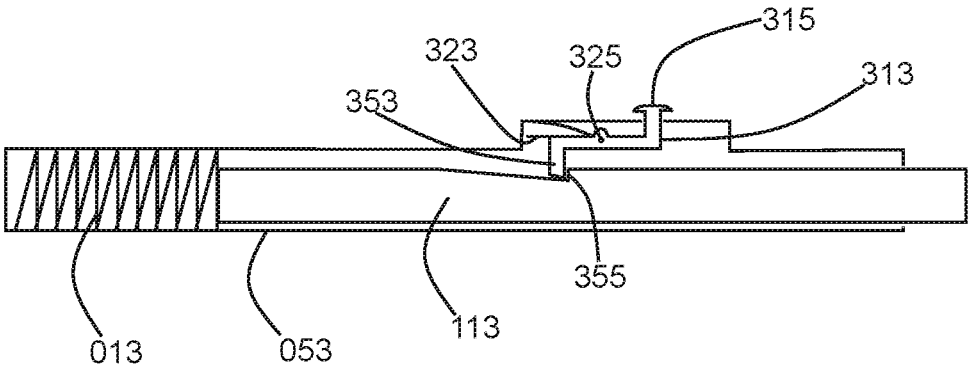
FIG. 16 provides a schematic of a bolt of an exemplary locking mechanism with a push-button latch, according to principles of the invention.

FIG. 16 provides a schematic of a bolt 115 of an exemplary locking mechanism with a push-button latch 515, according to principles of the invention. The bolt 115 slides in a barrel 305. A compression spring 315 urges the bolt 115 towards a locked position. To slide the bolt 115 to an unlocked position, the button 510 is pressed. Pressing the button causes the latch 515 to pivot about pin 520. Such pivoting raises a pawl 505 from a notch 500 in the bolt. A spring (e.g., leaf spring 525) urges the pawl 505 towards the notch 500. Embodiments of the locking mechanism as described above, optionally may be equipped with such a push button latch.

Figure 17:
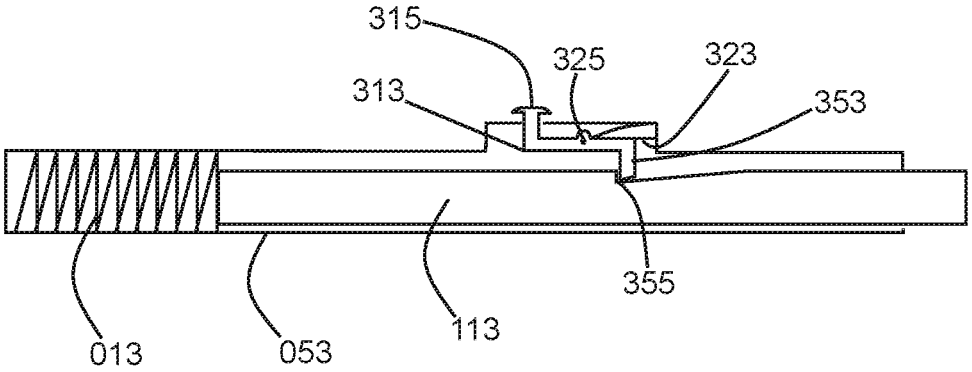
FIG. 17 provides another schematic of a bolt of an exemplary locking mechanism with a push-button latch, according to principles of the invention.

FIG. 17 provides another schematic of a bolt 115 of an exemplary locking mechanism with a push-button latch 515, according to principles of the invention. The bolt 115 slides in a barrel 305. A compression spring 315 urges the bolt 115 towards a locked position. In this embodiment, to slide the bolt 115 to a locked position, the button 510 is pressed. Pressing the button causes the latch 515 to pivot about pin 520. Such pivoting raises a pawl 505 from a notch 500 in the bolt. A spring (e.g., leaf spring 525) urges the pawl 505 towards the notch 500. Embodiments of the locking mechanism as described above, optionally may be equipped with such a push button latch.

Figure 18:
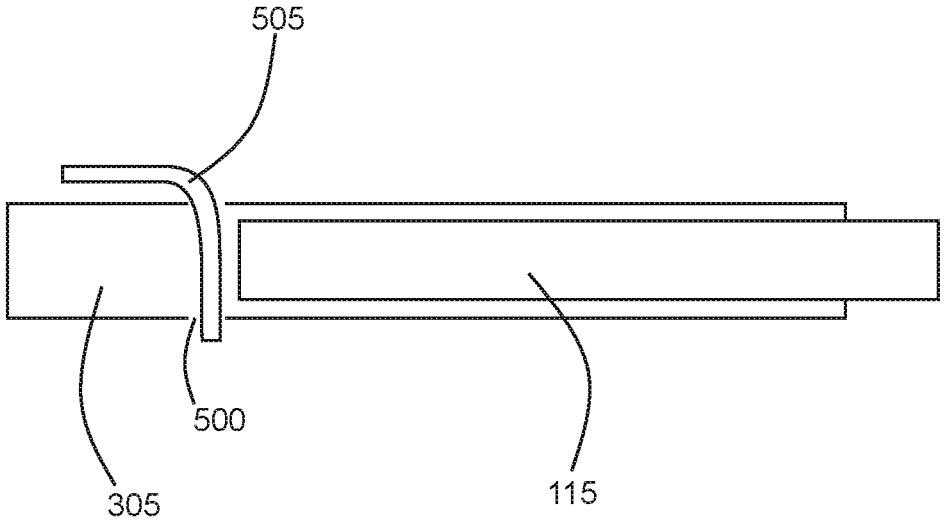
FIG. 18 provides a schematic of a bolt of an exemplary locking mechanism with a locking pin, according to principles of the invention.

FIG. 18 provides a schematic of a bolt 115 of an exemplary locking mechanism with a locking pin 505, according to principles of the invention. The pin 505 extends through a hole in the barrel 305, behind the bolt 115. The pin 505 prevents movement of the bolt 115 to an unlocked position.

Figure 20:
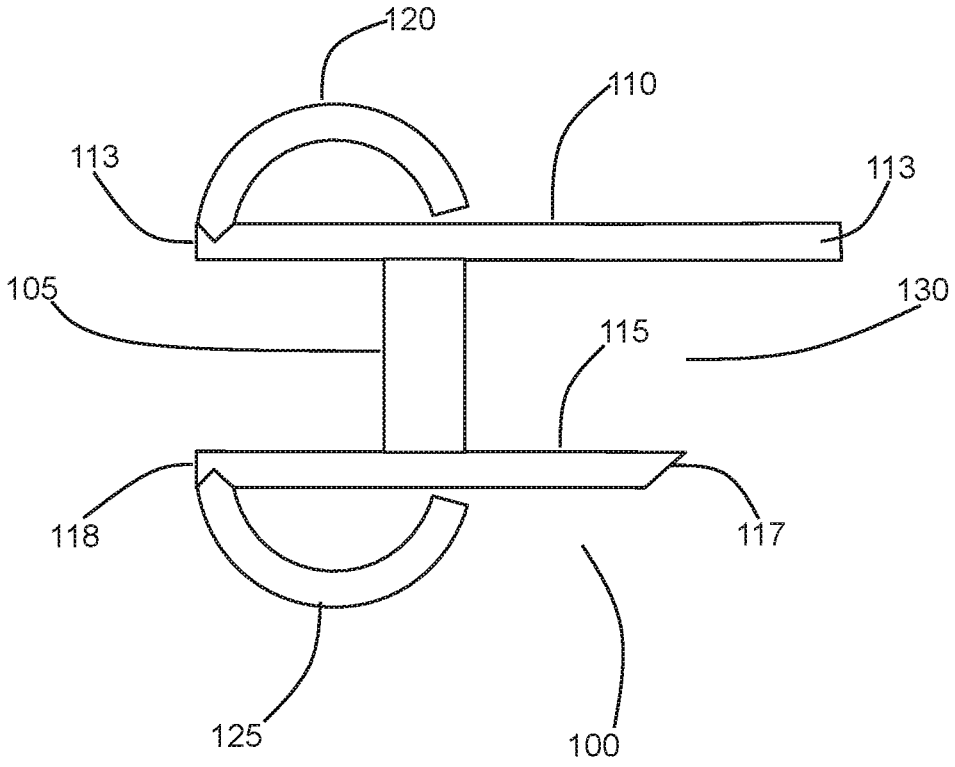
FIG. 20 conceptually illustrates an exemplary locking mechanism with a pair of parallel sliding bolts of uneven length, and one bolt having a beveled end, connected by a plate according to principles of the invention.

The bolts of a locking mechanism according to principles of the invention may be of different lengths. Many doors, gates and other swingable closures pivot to one side of an entryway, such as either inwardly or outwardly. The bolt that first encounters the frame or fence post during a closing motion may be longer or shorter than the other bolt. By way of example and not limitation, such a bolt 115 may be a latch bolt with a beveled end 117, and shorter than the other bolt 110, as conceptually shown in FIG. 20.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A locking mechanism for a hinged wing, the locking mechanism comprising:

a pair of bolts including a first bolt and a second bolt, the first bolt being spaced apart from and parallel to the second bolt, the first bolt including a first end, a second end opposite the first end and a first length from the first end to the second end of the first bolt, the second bolt including a first end, a second end opposite the first end and a second length from the first end to the second end of the second bolt;

a plate extending between the pair of bolts, the plate having a top, a bottom, a first side, a second side, a leading edge and a trailing edge, the first side of the plate being fixedly attached to the first bolt, the second side of the plate being fixedly attached to the second bolt, the leading edge being a determined distance from the first end of the first bolt, and the leading edge being the determined distance from the first end of the second bolt, and the plate having a thickness and a width, the width being a distance from the leading edge to the trailing edge, and the width being greater than the thickness of the plate and less than the first length of the first bolt and less than the second length of the second bolt.

2. The locking mechanism of claim 1, the locking mechanism further comprising a handle attached to at least one bolt of the pair of bolts.

3. The locking mechanism of claim 1, a first distance from the leading edge to the first end of the first bolt being about equal to a second distance from the trailing edge to the second end of the first bolt.

4. The locking mechanism of claim 1, each of the first bolt and the second bolt having a bolt diameter, and the bolt diameter being greater than the thickness of the plate.

5. The locking mechanism of claim 1, each of the first bolt and the second bolt having a bottom surface, a top surface and a bolt height measured from the bottom surface to the top surface, and the bolt height being greater than the thickness of the plate.

6. The locking mechanism of claim 1, the width of the plate being at least twice the thickness of the plate.

7. The locking mechanism of claim 1, further comprising a barrel, the barrel including a base and an open sleeve, the open sleeve being attached to the base, a portion of the first bolt being received in the open sleeve, the first bolt being movable linearly relative to the open sleeve.

8. The locking mechanism of claim 1, the first end of each of the first bolt and the second bolt being beveled, and the locking mechanism further comprising a first spring and a second spring, the first spring abutting the second end of the first bolt, and the second spring abutting the second end of the second bolt; and a strike comprising a protruding member with a pair of beveled edges facing the first end of each of the first bolt and the second bolt, and a strike width being a distance between the pair of beveled edges, and the strike width being less than a distance from the first side of the plate to the second side of the plate.

9. The locking mechanism of claim 1, further comprising a batten facing the leading edge of the plate, the batten having a batten width, and the batten width being less than a distance from the first side of the plate to the second side of the plate.

10. The locking mechanism of claim 1, further comprising a structural member with a pair of channels facing the first bolt and second bolt, each channel of the pair of channels being sized, shaped and positioned to receive a portion of one of the first bolt and second bolt when the first bolt and second bolt are in a locked position.

11. The locking mechanism of claim 1, the first bolt being movable from a locked to an unlocked position, and the locking mechanism further comprising a locking staple disposed between the position of the second end of the first bolt when the first bolt is in a locked position and the position of the second end of the first bolt when the first bolt is in an unlocked position.

12. The locking mechanism of claim 1, further comprising a keeper having a cross section of C-shape flanked with flanges, and the C-shape being sized and positioned to receive a portion of the first bolt, including the first end of the first bolt when the first bolt is in a locked position.

13. The locking mechanism of claim 1, the first bolt including a notch between the first end and the second end of the first bolt, and the locking mechanism further comprising a spring-biased latch movable from a locked position engaging the notch to an unlocked position releasing the notch.

14. The locking mechanism of claim 1, further comprising a barrel, the barrel including a base and an open sleeve, the open sleeve being attached to the base, a portion of the first bolt including the second end of the first bolt being received in the open sleeve, the first bolt being movable from an unlocked position to a locked position, the open sleeve including an aperture between the position of the second end of the first bolt when the first bolt is in the locked position and the position of the second end of the first bolt when the first bolt is in the unlocked position, and a pin removably inserted into the aperture and impeding movement of the first bolt from the locked position to the unlocked position.

15. A locking mechanism for a hinged gate, the hinged gate having a free end, and a fence post being adjacent to the free end, the locking mechanism comprising:

a slot through the gate, the slot extending horizontally a determined distance from the free end of the gate, the slot having a first end at the free end of the gate, and a second end opposite the free end of the gate;

a pair of bolts, the pair of bolts including a first bolt and a second bolt, the first bolt being spaced apart from and parallel to the second bolt, the first bolt including a first end, a second end opposite the first end and a first length from the first end to the second end of the first bolt, the second bolt including a first end, a second end opposite the first end and a second length from the first end to the second end of the second bolt;

a plate assembly extending between the pair of bolts, the plate assembly including a female plate with a plate channel attached to the first bolt, and a male plate attached to the second bolt, the male plate being at least partially received in the plate channel of the female plate, and the female plate having a thickness;

each of the first bolt and the second bolt having a bolt diameter, and the bolt diameter being greater than the thickness of the female plate; and the plate assembly being received in the slot, the plate assembly being movable from the first end of the slot to the second end of the slot, and the first bolt and second bolt being in a locked position when the plate assembly is adjacent to the first end of the slot, and the first and second bolt being in an unlocked position when the plate assembly is adjacent to the second end of the slot.

16. The locking mechanism of claim 15, the locking mechanism further comprising a handle attached to at least one bolt of the pair of bolts.

17. The locking mechanism of claim 16, further comprising a barrel, the barrel including a base and an open sleeve, the open sleeve being attached to the base, a portion of the first bolt being received in the open sleeve, the first bolt being movable linearly relative to the open sleeve.

18. The locking mechanism of claim 15, the first end of each of the first bolt and the second bolt being beveled, and the locking mechanism further comprising a first spring and a second spring, the first spring abutting the second end of the first bolt, and the second spring abutting the second end of the second bolt; and a strike attached to the fence post facing the first bolt and the second bolt, and the strike comprising a protruding member with a pair of beveled edges facing the first end of each of the first bolt and the second bolt, and a strike width being a distance between the pair of beveled edges, and, when the first bolt and the second bolt are in the locked position, the strike being between the first end of the first bolt being and the first end of the second bolt, and when the first bolt and the second bolt are in the unlocked position, the first end of the first bolt and the first end of the second bolt not reaching the strike.

19. The locking mechanism of claim 15, further comprising a batten attached to the fence post facing the leading edge of the plate, the batten having a batten width, and, when the first bolt and the second bolt are in the locked position, the batten being between the first end of the first bolt being and the first end of the second bolt, and when the first bolt and the second bolt are in the unlocked position, the first end of the first bolt and the first end of the second bolt not reaching the batten.

20. The locking mechanism of claim 15, further comprising a pair of channels formed in the fence post, the pair of channels facing the first bolt and second bolt, each channel of the pair of channels being sized, shaped and positioned to receive a portion of one of the first bolt and second bolt when the first bolt and second bolt are in the locked position, and not when the first bolt and second bolt are in the unlocked position.

* * * * *